US010138575B2

(12) United States Patent
van der Gaag et al.

(10) Patent No.: US 10,138,575 B2
(45) Date of Patent: Nov. 27, 2018

(54) USE OF A FOAMABLE POLYMER FILAMENT, AND FOAMED FABRIC

(71) Applicant: Ten Cate Nederland B.V., Almelo (NL)

(72) Inventors: Frederik Jan van der Gaag, Nijverdal (NL); Francesco Antonius Lodewijk Harmeling, Nijverdal (NL)

(73) Assignee: Ten Cate Thiolon B.V., Nijverdal (NL)

( * ) Notice: Subject to any disclaimer, the term of this patent is extended or adjusted under 35 U.S.C. 154(b) by 0 days.

(21) Appl. No.: 15/317,981

(22) PCT Filed: Jun. 10, 2015

(86) PCT No.: PCT/NL2015/050419
§ 371 (c)(1),
(2) Date: Dec. 12, 2016

(87) PCT Pub. No.: WO2015/190920
PCT Pub. Date: Dec. 17, 2015

(65) Prior Publication Data

US 2017/0121854 A1 May 4, 2017

(30) Foreign Application Priority Data

Jun. 12, 2014 (NL) ..... 2012994

(51) Int. Cl.
*D01D 5/247* (2006.01)
*D03D 15/00* (2006.01)
(Continued)

(52) U.S. Cl.
CPC ..... *D01D 5/247* (2013.01); *D01F 1/08* (2013.01); *D01F 1/10* (2013.01); *D03D 1/0035* (2013.01);
(Continued)

(58) Field of Classification Search
CPC .... D01D 5/247; D03D 15/0083; D03D 15/00; D03D 1/0035; D01F 1/08; D01F 1/10;
(Continued)

(56) References Cited

U.S. PATENT DOCUMENTS 3,100,926 A * 8/1963 Richmond ..... D01D 5/247 156/148
3,389,446 A * 6/1968 Parrish ..... D01D 5/247 264/321
(Continued)

FOREIGN PATENT DOCUMENTS

EP 2177335 A1 4/2010
GB 799609 A 8/1958
(Continued)

*Primary Examiner* — David Sample
*Assistant Examiner* — Donald M Flores, Jr.
(74) *Attorney, Agent, or Firm* — N.V. Nederlandsch Octrooibureau; Catherine A. Schultz; Lindsey A. Auerbach

(57) ABSTRACT

A foamed fabric comprising filaments of closed-cell foam of cross-linked polymeric material is formed by integrating the filaments into a precursor textile and subsequently foaming the material at a foaming temperature at which the filaments expand. The foamed fabric can be used for protective garments, pads, mats and the like.

19 Claims, 8 Drawing Sheets

(51) Int. Cl.
*D03D 1/00* (2006.01)
*D01F 1/08* (2006.01)
*D01F 1/10* (2006.01)

(52) U.S. Cl.
CPC ..... *D03D 15/00* (2013.01); *D03D 15/0083* (2013.01); *D10B 2321/021* (2013.01); *D10B 2321/08* (2013.01); *D10B 2401/08* (2013.01); *D10B 2501/04* (2013.01)

(58) Field of Classification Search
CPC ..... D10B 2321/08; D10B 2321/021; D10B 2501/04; D10B 2401/08
See application file for complete search history.

(56) References Cited

U.S. PATENT DOCUMENTS

| | | | | |
|---|---|---|---|---|
| 3,694,873 | A | 10/1972 | Crowley | |
| 4,186,068 | A | 1/1980 | Rubens | |
| 4,753,762 | A * | 6/1988 | Li | D01D 5/247 264/178 F |
| 6,007,911 | A * | 12/1999 | Bowen, Jr. | D01D 5/247 139/383 A |
| 6,221,486 | B1 | 4/2001 | Soane et al. | |
| 2001/0014394 | A1* | 8/2001 | Soane | C08J 9/04 428/364 |
| 2007/0141335 | A1 | 6/2007 | Perera et al. | |
| 2008/0099096 | A1 | 5/2008 | Kania et al. | |
| 2010/0021660 | A1 | 1/2010 | Slootweg et al. | |

FOREIGN PATENT DOCUMENTS

| | | | |
|---|---|---|---|
| GB | 1013957 | A | 12/1965 |
| NL | 6615471 | | 2/1967 |
| WO | 9823801 | A1 | 6/1998 |
| WO | 2008051072 | A2 | 5/2008 |

* cited by examiner

USE OF A FOAMABLE POLYMER FILAMENT, AND FOAMED FABRIC

BACKGROUND OF THE INVENTION

1. Field of the Invention

The present invention relates to foamed materials and to the manufacture thereof. In particular, the invention relates to the use of filaments of foamable polymeric material in the manufacture of a foamed fabric. The invention further relates to novel uses of such a foamed fabric which exhibits good impact resistance and cushioning while maintaining an open structure, allowing good ventilation or drainage.

2. Description of the Related Art

Foamed material is used in various applications for the purpose of cushioning or shock absorption. It has been available in sheets, mats and blocks since the 1930s as foam rubber. Initially natural latex rubber and styrene-butadiene rubber materials were used. More recently, polyurethane foams based on isocyanate have become common. Synthetic foam can be manufactured in various grades of density, thickness and softness according to the required use. It can also be present as open-cell foam or closed-cell foam, depending on the nature of the material and the method of manufacture. Closed-cell foam generally has the advantage that it can be exposed to moisture without the moisture being absorbed by the cell structure. Another advantage is that cushioning is much greater, since the closed cells can better absorb the force. A disadvantage of closed-cell foam is that it cannot transmit air or moisture. For many applications where moisture or air transport is required, existing foamed materials are unsuitable. Attempts have been made to improve the transport properties of foam materials e.g. for use in mattresses, by perforating a foam sheet with holes. An example of an aperture mattress insert is shown in U.S. Pat. No. 4,536,906. Such products do provide additional advantages but are still limited in their function. A foam insole for a shoe is shown in US2009119953, whereby apertures are provided to increase ventilation. Underlay shock pads of closed cell foam are also known in which apertures are formed to ensure adequate drainage, in particular, the ProGame™ shock pad from Trocellen GmbH.

It is also desirable to use foam materials in other situations where impact absorption or cushioning can be required. This can be required as a layer in protective garments, furnishings and the like. In such contexts, breathability is also often a requirement. So too is the ability to integrate the foam layer within a multi-layer structure, often around a complex shape. It would be desirable to provide an alternative construction for a fabric that allowed the use of closed-cell foam material while maintaining desirable properties of breathability and water transport. Additionally, existing foam layers have a fixed two-dimensional form i.e. they can flex but cannot easily skew in the plane of the layer without deformation. In the past, underlays and mats formed of foam material have been subject to creasing and distortion due to their inability to skew or stretch Additionally, foamed layers are generally of relatively low strength, especially when present as relatively thin layers. Attempts to improve on the strength of foam have considered the incorporation of fibrous materials. An example of a foamed laminar product with incorporated reinforcement fibres is given in EP2177335. Attempts have also been made in the past to integrate foam material into textile like constructions. DE 2730915 shows the use of open-cell foam strips woven together to form a carpet underlay. The handling of strips of foam material is difficult and integration of such foam strips into a fabric is not easily achieved. It would be desirable to provide an improved process by which foamed fabric layers could more easily and conveniently be produced.

BRIEF SUMMARY OF THE INVENTION

Described herein is a process by which a foamable polymeric filament is used in the manufacture of a foamed fabric. The process comprises providing filaments of a foamable polymeric material, cross-linking the foamable polymeric material, integrating the filaments into a fabric and subsequently foaming the polymeric material to form a closed-cell foamed structure. As a result of the proposed use of foamable polymeric filaments, the foamed fabric is breathable and can readily permit transport of air or moisture along and through the fabric. Because the polymeric material is present as a closed-cell foamed structure, the fabric will not absorb water or dirt in its material structure and is suitable for various uses as outlined below. In particular, the voids formed within the closed-cell structure can be compressed to absorb forces in the manner of an air spring. For an open-cell structure, once water or dirt has been absorbed, the structure is filled and cannot be further compressed, whereby the shock absorbing property is lost.

The filaments can take any appropriate shape and can be produced in any suitable fashion. In one aspect, the filaments can be provided by cutting a sheet of foamable polymeric material into elongate strips. The strips can be relatively wider than their thickness prior to foaming. Typically, the strips can have a width of between 1 mm and 5 mm and a thickness of between 1 mm and 2.5 mm prior to foaming. The filaments can be provided either before or after the material is cross-linked. In the case of elongate strips, it is possible to first cross-link the polymeric sheet material and thereafter form the strips.

In another aspect, the filaments can be provided by extrusion. This can take place either by extrusion as a sheet and subsequent cutting into strips or the filaments can be extruded directly through an extrusion head or spinneret of appropriate form. Such extruded filaments can be round, flat, profiled, solid, hollow or otherwise and the skilled person will understand that the filament shape can be determinative of the final properties of the fabric. In addition to the extrusion of single filaments, multi-filaments can also be extruded together.

Cross-linking of the foamable polymeric material can take place in any appropriate manner both before, after or while forming the filaments. In one aspect, the polymeric material is chemically cross-linked using an appropriate chemical cross-linking agent. Such a process is also often referred to as reticulation, whereby the polymeric chains are broken down and subsequently re-ordered to form a three dimensional network. Not wishing to be bound by theory, it is believed that cross-linking prevents macroscopic melting of the fibre during foaming and furthermore that the network formed prevents gases produced during foaming from freely escaping. The chemical cross-linking agent can be a peroxide agent, a peroxide co-agent or a silane system. In another aspect, the chemical cross-linking agent is an organic peroxide. Such organic peroxides include, but are not limited to, tertbutylperbenzoate, peroxide of benzoil, 2,4 dichlorobenzoilperoxide, acetylperoxide, lauryl peroxide, methylethylketone peroxide and dicumyl peroxide. The skilled person will be well aware of particular choices of agent and their benefits in relation to the desired result in producing a foam filament having the required properties as outlined elsewhere.

Additionally, the foamable polymeric material can be physically cross-linked, in particular using appropriate high-energy radiation, which can include, but is not limited to, UV, microwave, electron beam, X-ray and gamma ray radiation and can be particulate or non-particulate. An advantage of physical cross-linking is that the process can be initiated at a desired point in the production process of the fabric and can also be locally initiated at precise locations on the fabric. Additional chemical agents such as trimethylolpropane triacrylate (TMPTA), carbon black or polar additives can be included in the foamable polymeric material in order to enhance the cross-linking process or adapt it to the applied radiation.

The foamable polymeric material can be cross-linked prior to integrating the filaments into the fabric. For extruded filaments, this can take place at or after extrusion. Alternatively, the cross-linking can take place after integrating the filaments in the fabric.

Foaming of the foamable polymeric material can take place according to any suitable mechanism, including the use of direct gassing or physical blowing, with or without the addition of appropriate nucleating agents. The foamable polymeric material may comprise a chemical blowing agent adapted to foam at a given foaming temperature or temperatures. The blowing agent can be an endothermic blowing agent such as acid/carbonate based systems or can be an exothermic blowing agent such as hydrazines, hydrazides, carbazides, azo compounds and the like. Forms of blowing agents can include, but are not limited to, azodicarbonide, polybenzene sulfonahydrazine, 4,4' difenylsulfonilazide, p,p' oxybis, benzenesulfonylhydrazide or dinitrosopentamethylene tetramine. Alternatively, an appropriate mixture of both endothermic and exothermic blowing agents can be used, whereby the reaction rate can be controlled, both in temperature and in time.

According to an aspect of the invention, cross-linking of the foamable polymeric material can be performed such that after cross-linking has occurred, the melting temperature of the foamable polymeric material is above the foaming temperature. In this manner the foamable polymeric material remains stable at and above the foaming temperature, whereby a closed cell structure of the foam results. It will be understood that careful selection of the various agents and control of the processes is required to achieve the desired result. For a foamable polymeric material that is formed by extrusion, it is necessary to melt the material in order for extrusion to take place. Nevertheless, during this process, activation of the blowing agent is to be avoided, since otherwise foaming would commence during extrusion and subsequent integration of the filaments into the fabric would be impeded. Foaming without cross-linking generally leads to open cell foam structures that are undesirable for many commercial purposes. Cross-linking of the filament serves to raise its melting temperature to above the foaming temperature at which the blowing agents activate. It will also be understood that the foaming temperature should be below critical temperatures of any other fibres or components of the fabric unless melting or activation of these components is specifically required. The resulting foamed fabric can thus have a higher melt temperature than the prefoamed polymer. This may be important in particular in garment applications where laundering, drying or other end uses at elevated temperatures could be detrimental to the fabric.

The foamable polymer filament can be integrated into the fabric in any appropriate manner including by weaving, felting, knitting or the like. According to an aspect of the invention, the fabric is a woven fabric and the step of integrating the filaments into the fabric comprises weaving a textile having a warp and a weft. In the following, the term fabric will be used in its most generic sense as covering all forms of fibre or filament based sheet materials. It can include pile fabrics such as carpets, rugs, turf and the like and also non-pile fabrics. The invention is particularly applicable to non-pile fabrics. The term textile, will be used to exclude fabrics having two-dimensional rigidity such as carpets, certain felts and mesh where relative fixation of the fibres prevents skewing. These fibrous articles, although sometimes referred to as textiles, are internally linked in such a way that they maintain a substantially fixed two-dimensional form. Even though they can be flexible in a third dimension they are not generally free to skew or distort within the plane of the fibre layer. It will be noted that the present invention can be applicable to fabrics that are textiles according to the above definition prior to foaming but which become locked and thereafter act as fabrics, subsequent to the foaming step.

In one aspect of the invention, the filaments are provided in the warp. Integrating the filaments into a textile in this manner allows the filaments to be supplied from a boom or creel in a conventional loom. For flat filaments or tapes, the orientation of the filament in the warp can be easily maintained. The filaments can be present in the warp as monofilaments or as multifilaments. In addition, such filaments can be present in the warp together with additional fibres of other materials e.g. high strength fibres. These filaments can be combined with the foamable polymer filaments as multifilaments or otherwise.

Additionally or alternatively, the filaments can be integrated into a woven textile by insertion into the weft. Insertion into the weft can be by any conventional process, including but not limited to, insertion by shuttle, rapier, airjet, projectile and waterjet and can include multi-axial weft insertion. As in the case of the warp, the filaments can be present in the weft alone or in combination with fibres or filaments of different, in particular non-foaming materials. The skilled person will be well aware of the different weave structures that can be achieved in this manner and the present invention is not intended to be limiting to any particular weave.

According to the invention, the foamable polymeric material can be any material capable of being processed as described above or hereinafter. A class of materials which can be employed as foamable polymeric materials include polyethylene (PE) or ethylene vinyl acetate (EVA) or a blend thereof, including HDPE, LDPE and LLPDE. The properties of the resulting foam will depend partly upon the density of material chosen, whereby HDPE will tend to result in a stiffer foam. Normal PE has a melting temperature varying from around 120° C. for LDPE to 135° C. for HDPE, which makes it highly suitable for extrusion at temperatures around 150° C. Cross-linking to form PEX can increase the melting temperature or otherwise ensure that the resultant material remains stable to well above 180° C. Conveniently, using conventional chemical cross-linking agents, the cross-linking process can be performed at temperatures of around 170° C., thereby ensuring that the process does not commence during extrusion itself. By providing a blowing agent, active at around 180° C., foaming of the PEX can take place subsequently be exposing the fabric or textile to the foaming temperature. It will be understood that the other components of the fabric or textile should be chosen to withstand this elevated temperature, at least for the time required for foaming to occur.

According to an another aspect of the invention, there is also disclosed a method comprising forming the fabric into a further product, whereby foaming takes place subsequent to forming of the further product. Forming of the fabric into a further product is intended to include any step that changes the initial fabric into which the filaments have been integrated into a different form. This can include cutting or otherwise confecting the fabric into a final product such as a garment or the like or can also include shaping or distorting the fabric prior to foaming. Moulding processes may also be applied to form complex shapes such as helmets, shoes, seat backs and the like and the step of forming may even take place prior to cross-linking. In one particular embodiment, integration of the filaments can take place by weaving of a textile and the textile can subsequently be skewed to form a skewed textile. Foaming can be used to convert a textile into a fabric by effectively locking the filaments into a 2-D stable configuration. During foaming, although the material does not melt at a macroscopic level, it can become tacky at its surface, whereby adjacent filaments can fuse together. Moreover, due to oxygen inhibition, cross-linking at the surface may be reduced, increasing the local tackiness and increasing the tendency of filaments to locally fuse together. Such a process can be particularly convenient for the production of padded garment portions, since the portion can be confected to the desired shape and then foamed to form a self-supporting 3-D structure.

The invention further relates to a foamed fabric comprising filaments of closed-cell foam of cross-linked polymeric material. The filaments can be integrated into the fabric as described above or hereinafter.

In an aspect, the foamed fabric is a woven fabric comprising a warp and a weft. The filaments can be arranged in the warp. Alternatively or additionally, the filaments can be arranged in the weft.

Although the fabric can be manufactured exclusively from filaments of closed-cell, cross-linked, polymeric foam, these filaments can be combined with other fibres or filaments of non-foamed materials. These other fibres can be used to provide desired characteristics to the final product, namely strength, stability, liquid transport and the like. Alternatively, other fibres can be present for the purpose of production and can be subsequently eliminated. The invention is not restricted by the nature of such other fibres, which can include both natural and artificial fibres, high-strength fibres, metal wires, optical fibres and any other form of filament that can be integrated with the foam filaments to form a fabric. Exemplary fibres can be high-strength fibres, wicking fibres, conductive fibres and may include jute, polyester, fibreglass, cotton, wool, viscose and cellulose.

The overall percentage of the foam filaments in the final fabric will depend upon the desired properties. In general, the foam filaments can be present as at least 20% of the fabric by weight. In another aspect, the foam filaments can be present as at least 45% of the fabric by weight. In certain constructions, the filaments can be present as at least 70% of the fabric by weight. Generally the foam filaments will not exceed 95% of the fabric by weight.

The other fibres that can be present in the fabric can be of a similar size to the filaments or can be of a different size. In general, denier or dTex is used to define the fibres being used, although it will be understand that this is a measure of yarn weight per unit length rather than volume, which may thus not be apt to compare fibres or filaments of different densities. In general, the filaments can be present in any weight that can be woven with the chosen machine. Weights of between 100 dTex and 1000 000 dTex may be utilised and optionally between 10 000 dTex and 50000 dTex. The other fibres can be present in similar weights to those of the filaments but will generally be between 100 dTex and 5000 dTex. In terms of size, the filaments can vary in size with respect to the other fibres from a value of 0.1× to 100× the cross sectional area in the unfoamed state. It will be understood that the form of the final fabric will be strongly dependent upon this ratio. In some aspects, the other fibres can be present as much thinner fibres than the filaments, and can thus more easily accommodate the larger filaments, especially after foaming.

Furthermore, according to an aspect of the invention, the foamed fabric can have a net density of between 30 $Kg/m^3$ and 100 $Kg/m^3$, or, in some aspects, between 45 $Kg/m^3$ and 70 $Kg/m^3$. Such relatively low density materials offer significant advantages over existing materials in terms of their ability to protect, cushion or resist shock while remaining lightweight, making them ideal for garments and the like. In this context, the net density is the mass per unit volume displaced by the material, which may be measured by immersing a sample of material in water and determining the volume displaced. It will be understood that the gross density can be even lower based on the overall volume occupied by the fabric when stacked e.g. between flat layers. This is because the fabric structure can leave additional air spaces that increase the overall volume occupied.

According to a still further aspect of the invention, the foam filaments can extend out of a plane of the fabric i.e. in the Z-direction, where the fabric has a local X-Y orientation. In certain embodiments this may be in the form of open arches. This can be achieved by appropriate anchoring of the foam filaments within the fabric such that during foaming they can expand to form such arches. These arches further add to the overall volume of the fabric and lead to a very low gross density. They also further improve the shock absorbing capacity of the foamed fabric, since the arches provide support due both to their material properties in compression and to their structural properties i.e. as a result of their shape due to bending forces in the arch or loop. Such a structure can be particularly advantageous in terms of water-draining properties or the like. In the case of a woven fabric, if foamable filaments in the warp pass over a number of non-foaming weft threads and subsequently pass under a different number of weft threads, differently sized loops or arches are produced on either side of the fabric. Thus, for example, relatively small loops can be formed on a first side of the fabric, while the loops on the other side of the fabric can be larger in order to provide better elasticity and/or damping.

In one aspect, the foamed fabric can have a thickness of at least 5 mm with a weight of less than 1000 $g/m^2$. In another aspect, the foamed fabric can have a thickness of at least 10 mm with a weight of less than 750 $g/m^2$.

In terms of properties, the foamed fabric can be designed to have a wide range of characteristics to meet the requirements of its particular use.

In addition to the finished product described above, the invention also relates to an unfoamed precursor textile manufactured by use of the foamable polymer filament as described above. On subjecting the precursor to the foaming temperature, for instance at a temperature of at least 150° C., the precursor expands to form a foamed fabric as described above. In some aspects, the precursor is a woven textile.

In some aspects, the precursor fabric expands at the foaming temperature by at least 5 times its volume, at least 10 times, or, in some aspects, to at least 20 times its volume.

The precursor and/or the foamed fabric can be used for manufacture of any appropriate products. In particular, the invention includes but is not limited to garments, mats, underlay, furnishing, seating elements, footwear, mattresses, headwear, helmets, tarpaulins, impact absorbing structures, padding, swimming pool covers and any other structures comprising foamed fabric as described above and hereinafter.

BRIEF DESCRIPTION OF THE DRAWINGS

The features and advantages of the invention will be appreciated upon reference to the following drawings of a number of exemplary embodiments, in which.

DETAILED DESCRIPTION

Figure 1:
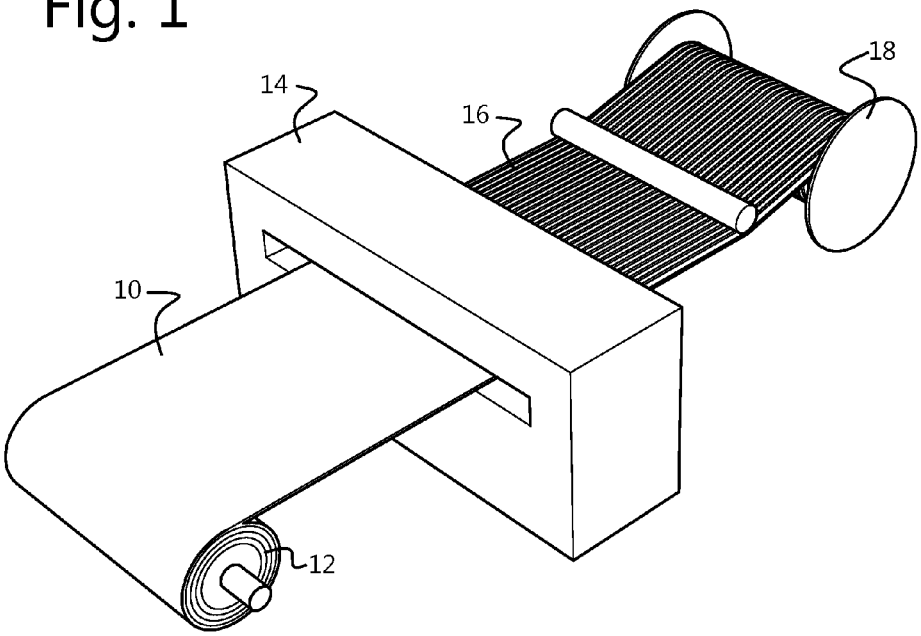
FIG. 1 shows a perspective view illustrating the production of filaments of foamable polymeric material according to the invention.

An exemplary procedure for forming filaments of foamable polymeric material is shown in perspective view in FIG. 1. According to the figure, an extruded, cross-linked sheet 10 of foamable material is fed from a roll 12 through a strip forming device or shredder 14. The sheet 10 is cross-linked PE available from Sekisui under the name Alveocel™ LUT 4501 1.3 mm. Other similar materials are available from Trocellen GmbH and appropriate procedures for forming such foamable cross-linked polymeric materials are disclosed in EP0476798. On passing through shredder 14, the sheet 10 is cut into multiple filaments 16, each having a width of 4 mm, which are subsequently wound together onto a spool 18. The wound strip has a dTex value of around 38 000.

Figure 2:
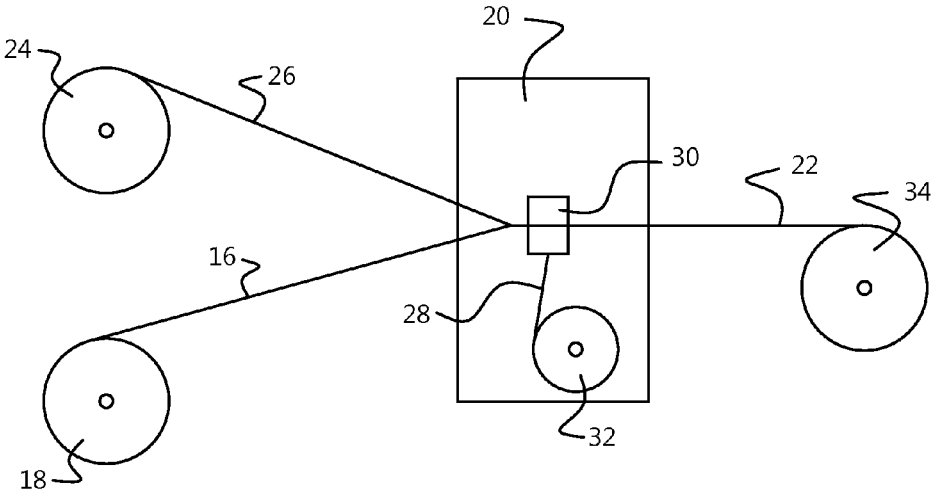
FIG. 2 shows in schematic view a weaving machine operational to integrate the filaments of FIG. 1 into a woven textile.

FIG. 2 shows in schematic view a weaving machine 20 operational to integrate the filaments 16 into a woven textile 22. A number of spools 18 produced according to the process of FIG. 1 are mounted for delivery of filaments 16 into the warp direction of machine 20 at a spacing of 1 cm. An additional beam 24 of 370 dTex PET warp threads 26 is mounted in the warp direction such that the filaments 16 repeat at a rate of one filament for every 27 warp threads. The beam 24 and weaving machine 20 have an active width of 2.1 meters. It will be understood that this configuration is merely exemplary and that other weaving structures can also be chosen as detailed below. In the weaving machine 20, a pair of PET weft threads 28, each of 1100 dTex are inserted by a projectile weft insertion device 30 from a reel 32 at a spacing of 54 threads/10 cm. The woven textile 22 is wound onto a textile roll 34 for subsequent processing.

Figure 3:
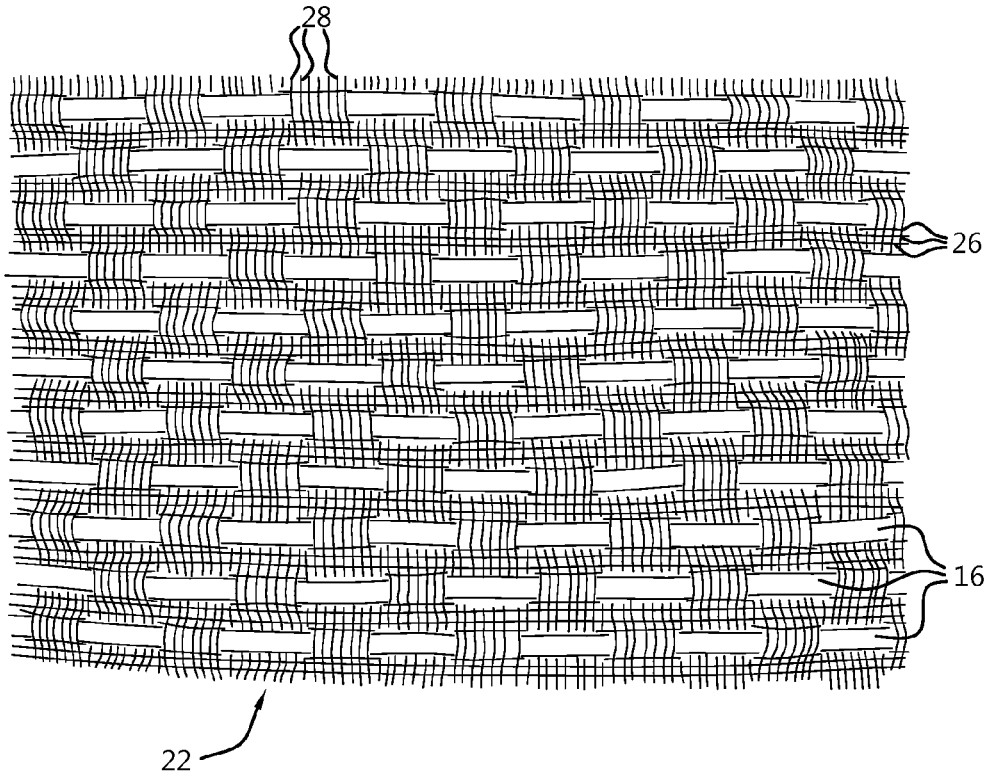
FIG. 3 shows a plan view of part of the woven textile produced according to the invention in the machine of FIG. 2.

FIG. 3 is a plan view of a portion of the textile 22 produced in the machine 20. According to this weaving pattern, the filaments 16 are equally spaced on the frontside and the backside of the textile 22 in that respectively seven weft threads 28 pass over a given filament 16, followed by seven weft threads 28 passing beneath it. The warp threads 26 are woven in plain weave with the weft threads 28. The resulting textile 22 has a weight of 556 g/m$^2$, comprising approximately 390 g/m$^2$ of the filaments 16, 100 g/m$^2$ of the warp threads 26 and 65 g/m$^2$ weft threads 28.

Figure 5:
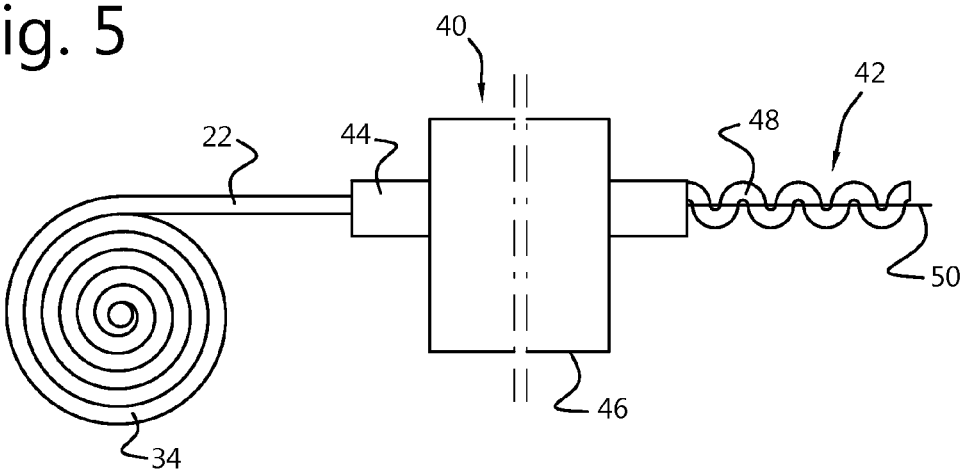
FIG. 5 shows a side elevation of the tenter oven of FIG. 4.
Figure 4:
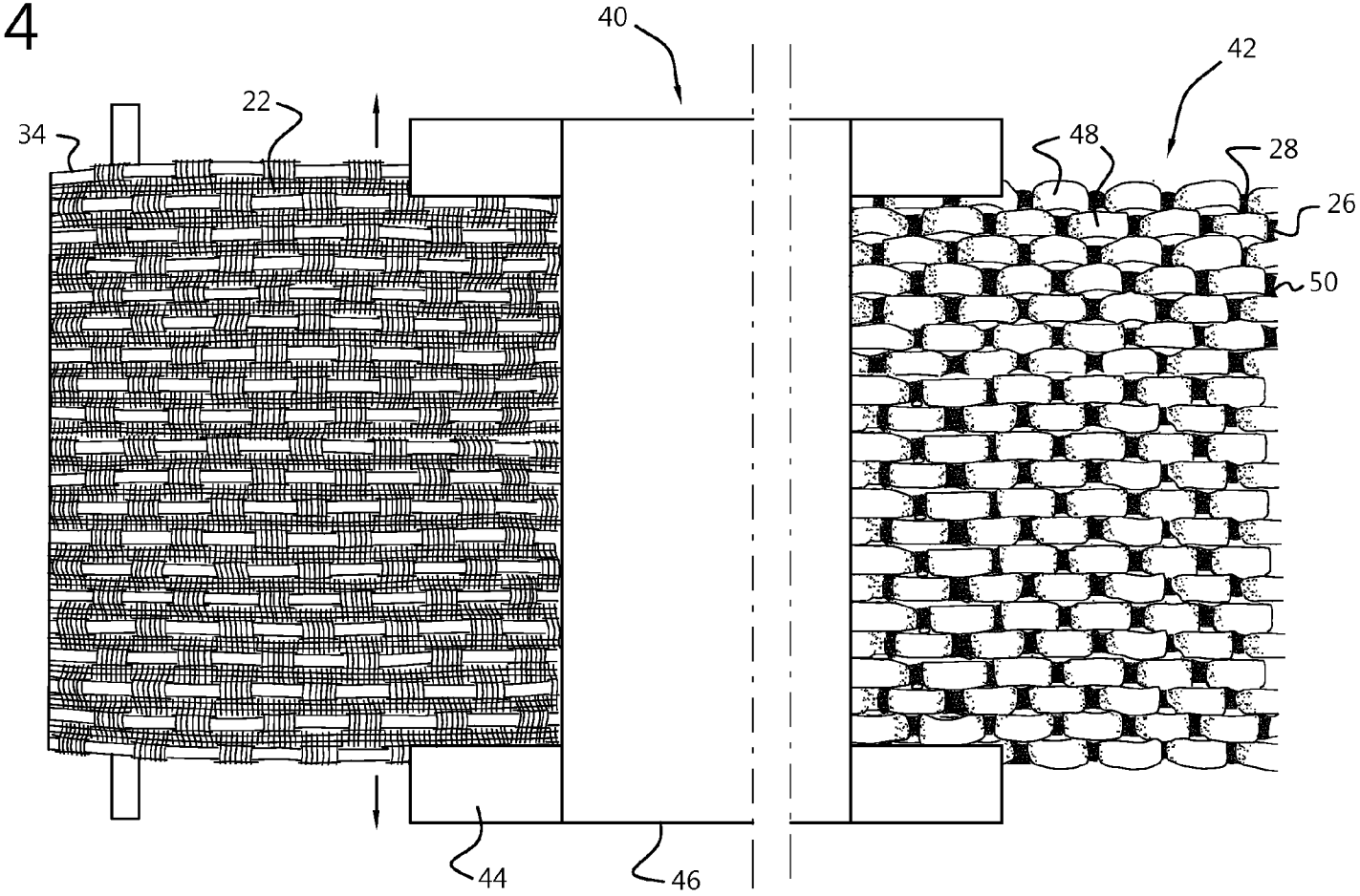
FIG. 4 shows in schematic plan view a tenter oven in use in converting the textile of FIG. 3 into a foamed fabric.

FIG. 4 shows in schematic plan view a tenter oven 40 being used in a finishing process on the textile 22 for the formation of a foamed fabric 42. The tenter oven 40 is shown in FIG. 5 in side elevation. According to FIGS. 4 and 5, the textile roll 34 is mounted to deliver the textile 22 to the tenter oven 40. To this end, the sides of the textile 22 are gripped by the tenter frame 44 which stretches the textile 22 laterally as it is carried through beneath heater 46. The heaters 46 subject the textile 22 to a foaming temperature of 190° C. for a time of 3 minutes as it is carried through the tenter oven at a speed of 3 meters per minute. During the heating phase, the blowing agent in the foamable polymeric filaments 16 is activated and the filaments 16 expand multiaxially. Because of the manner in which the textile 22 has been woven with equal numbers of weft threads 28 on both sides of the filaments 16, the filaments expand to form upstanding arches 48 extending above and below a base layer 50 formed by the warp and weft threads 26, 28. The foamed filaments 16 exhibit a net volume increase that is around eight times greater than prior to foaming. The overall gross increase in volume is somewhat greater due to the space occupied by the arches 48.

Figure 6:
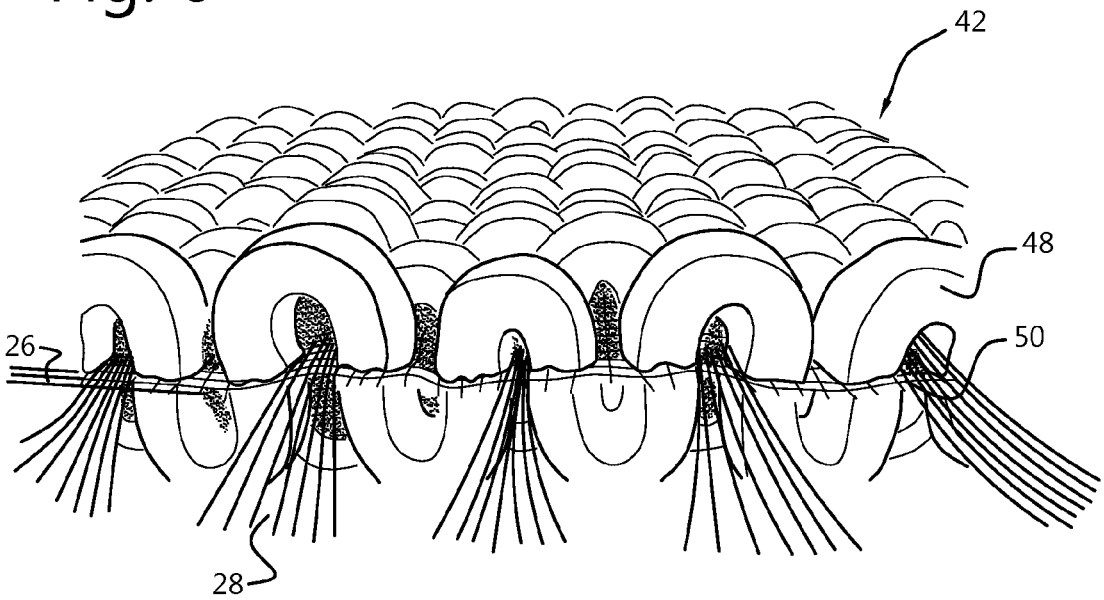
FIG. 6 shows a perspective view of part of the foamed fabric produced in the tenter oven of FIG. 4.

A close up perspective view of part of the foamed fabric 42 is shown in FIG. 6 illustrating the upstanding arches 48 extending above and below the base layer 50.

Figure 7:
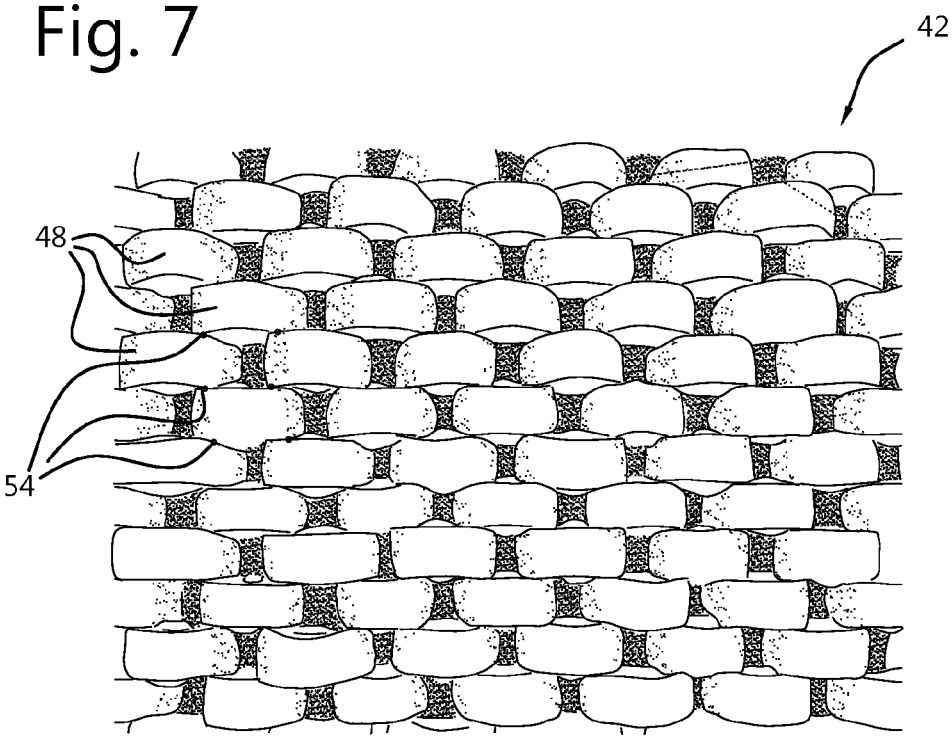
FIG. 7 shows a plan view of the foamed fabric of FIG. 6.

FIG. 7 shows a top elevation of the foamed fabric 42, which additionally illustrates the manner in which adjacent arches 48 engage against each other and partially fuse during the heating process to form bridges 54. These bridges 54 serve to stabilise the structure of the foamed fabric 42 making it 2-D stable and preventing skewing thereof. It will be understood that although in this aspect the structure of the precursor textile ensures that bridges 54 are formed after foaming, it is also possible to produce a foamed fabric without such bridges, whereby the foamed fabric remains a textile in that it remains deformable or skewable within the plane of the base layer.

The foamed fabric 42, produced as described above was tested and exhibited exemplary properties. A number of tests were carried out on the foamed fabric 42 described above according to the methods outlines in the FIFA Handbook of Test methods January 2012 edition. The test sample achieved results for Vertical Deformation: 6.45 mm; Force Reduction 23.95%; Energy Restitution: 71.75% and Shock Absorption (first, second, third impact): 39.3%, 25.3%, 22.6%. Another similar sample of the foamed fabric 42 was subjected to water flow testing according to ASTM D4491 and achieved average flow meter readings of 1.59 g/m based on five sample locations (temperature correction factor: 0.9097; average sample thickness: 8.24 mm; permittivity: 0.898/s; permeability: 0.741 cm/s). Depending upon the fabric construction, it is expected that water flow rates of anywhere from 0.5 g/m to 5 g/m could easily be achievable.

Figure 8:
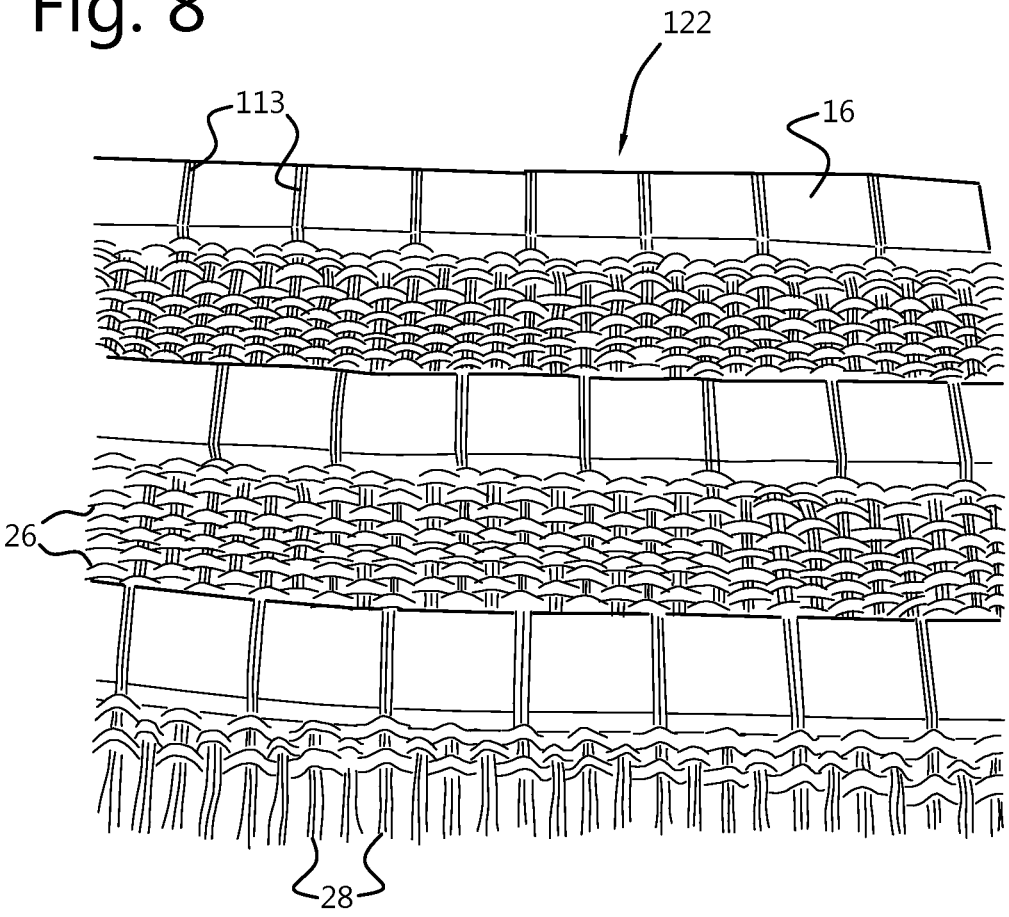
FIG. 8 shows a perspective view of a portion of woven textile according to an alternative embodiment of the invention.

FIG. 8 shows in perspective view an aspect of a woven textile 122 for use as a precursor in the formation of a foamed fabric. In this example, the filaments 16 are woven in an asymmetric manner with respect to the weft threads 28 in what can be termed a satin weave. Thus, each filament 16 passes over three weft threads 28, and subsequently is captured under one weft thread 28. The weft threads 28 are in this case present as thread bundles or multi-strand threads. The remaining warp threads 26 are woven in a plain weave with respect to the weft threads 28.

Figure 9:
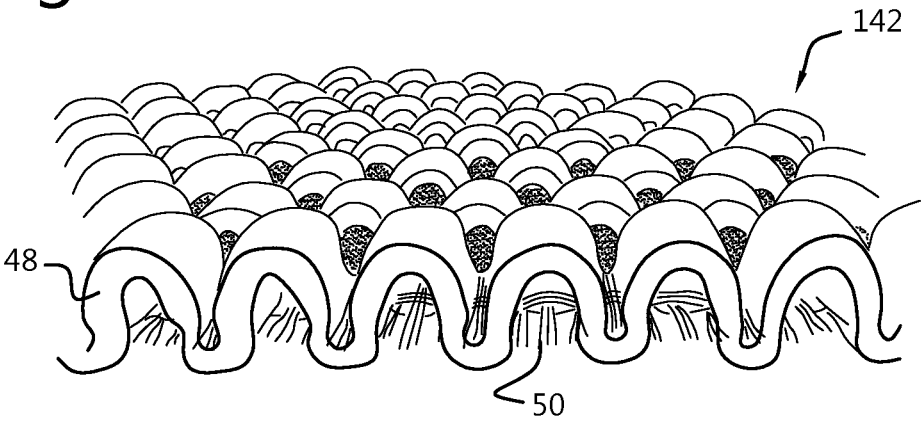
FIG. 9 shows a perspective view of a foamed fabric formed from the textile precursor of FIG. 8.

FIG. 9 shows the woven textile 122 of FIG. 8 in perspective view after it has been finished or foamed to form a foamed fabric 142. The foaming step can take place in the tenter oven 40 as described in relation to FIG. 4. As can be seen, the filaments 16 of foamable polymeric material have expanded to form arches 48, which in this case are upstanding only from the frontside of the base layer 50. At the backside of the foamed fabric 142 (in the figure, the lower side is designated as the backside), the filaments 16 have remained largely in the plane of the base layer 50. The relatively higher arches will collapse under a lower load than those of the embodiment of FIG. 6.

Figure 10A:
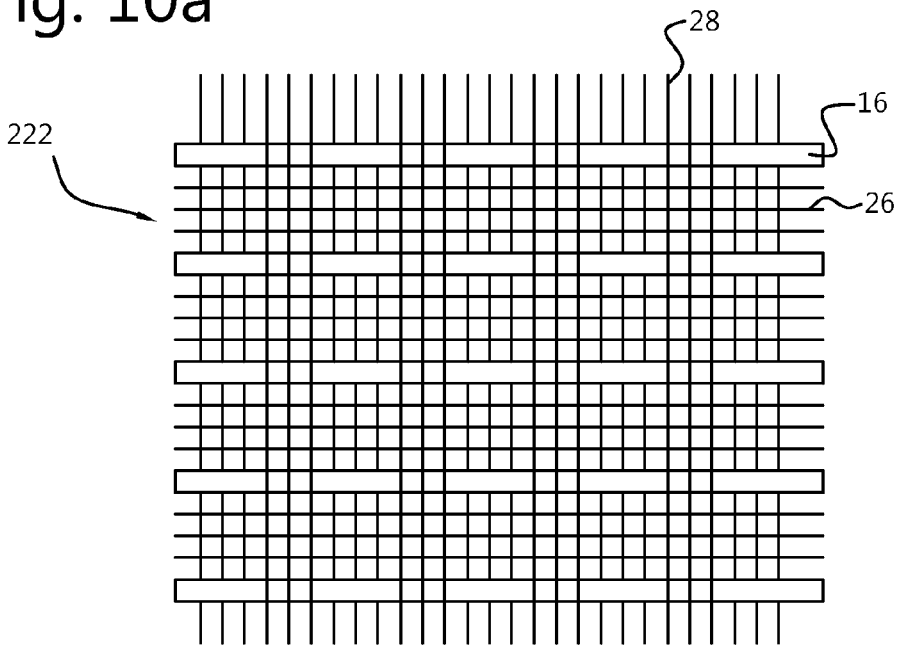
FIGS. 10A and 10B show in plan view a further alternative embodiment of a woven textile for producing a skewed fabric.

FIG. 10A shows in plan view a further aspect of a woven textile 222 for use as a precursor in the formation of a foamed fabric. In this example, the foamable filaments 16 are oriented in the warp direction and are woven in a loose plain weave with further warp threads 26 and weft threads 28.

Figure 10B:
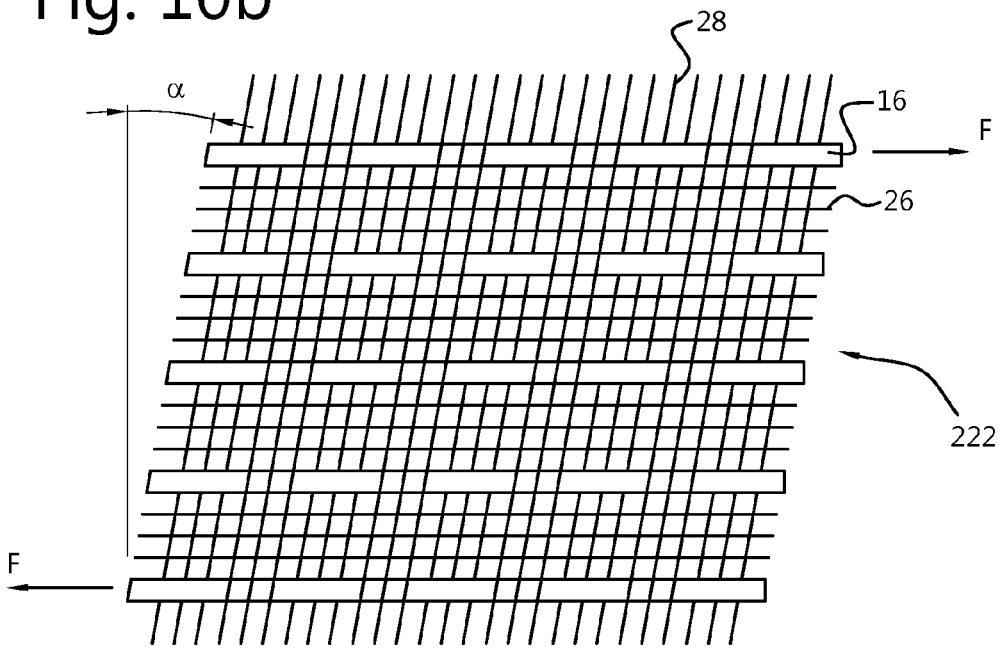

In FIG. 10B, the woven textile 222 is subjected to a further processing step of skewing, whereby a force F is applied to distort the weave structure through an angle $\alpha$. Foaming takes place by application of heat as described above, while maintaining the force F. After completion of the foaming process, the resulting foamed fabric is stable in the skewed orientation due to the formation of bridges between adjacent arches as described above.

Figure 11A:
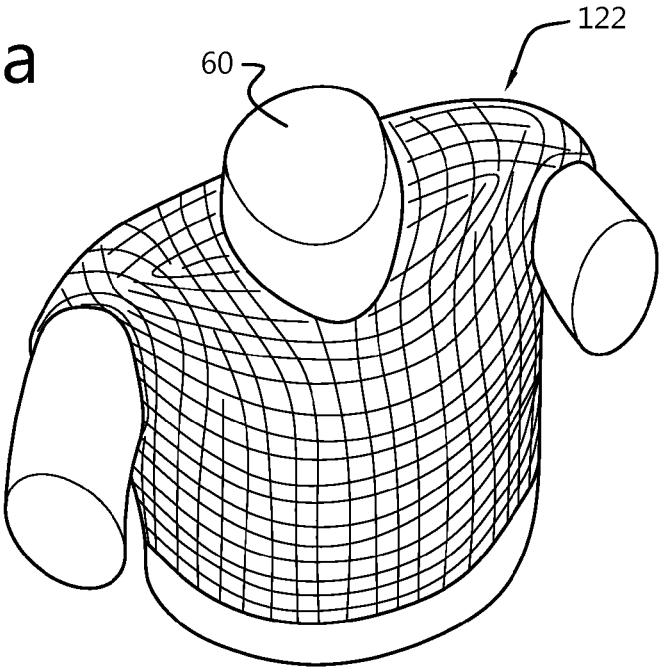
FIGS. 11A and 11B show schematic perspective views of a shoulder pad confected from the precursor textile of FIG. 8.
Figure 11B:
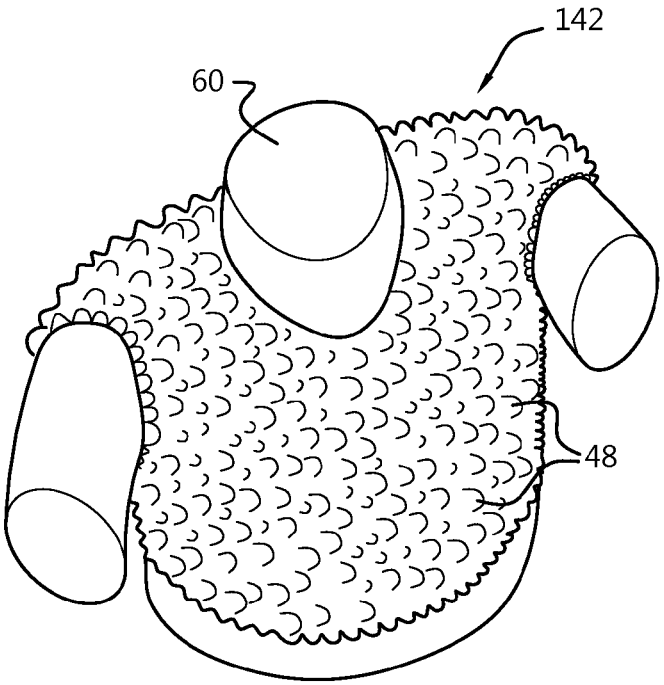

FIG. 11A illustrates in perspective view a step in the confection of a protective shoulder pad using the precursor textile 122 of FIG. 8 that has been trimmed to an appropriate size. The weave of the precursor textile 122 is sufficiently loose that it can easily deform or drape to follow the contours of a mould or in this case a mannequin 60. The mannequin 60 with the precursor textile 122 is then subjected to heat treatment at the foaming temperature to expand the foam filaments 16. FIG. 11B shows the mannequin 60 after foaming has taken place. The foamed fabric 142 has expanded with the formation of foam arches 48 which are connected together, thus forming a resilient shoulder pad 62, which retains its shape even once removed from the mannequin. The shoulder pad 62 provides excellent cushioning and good ventilation due to its open structure. It will be understood that the same or similar procedure can be used to form fabric elements of many different shapes and forms as can be required.

Figure 12:
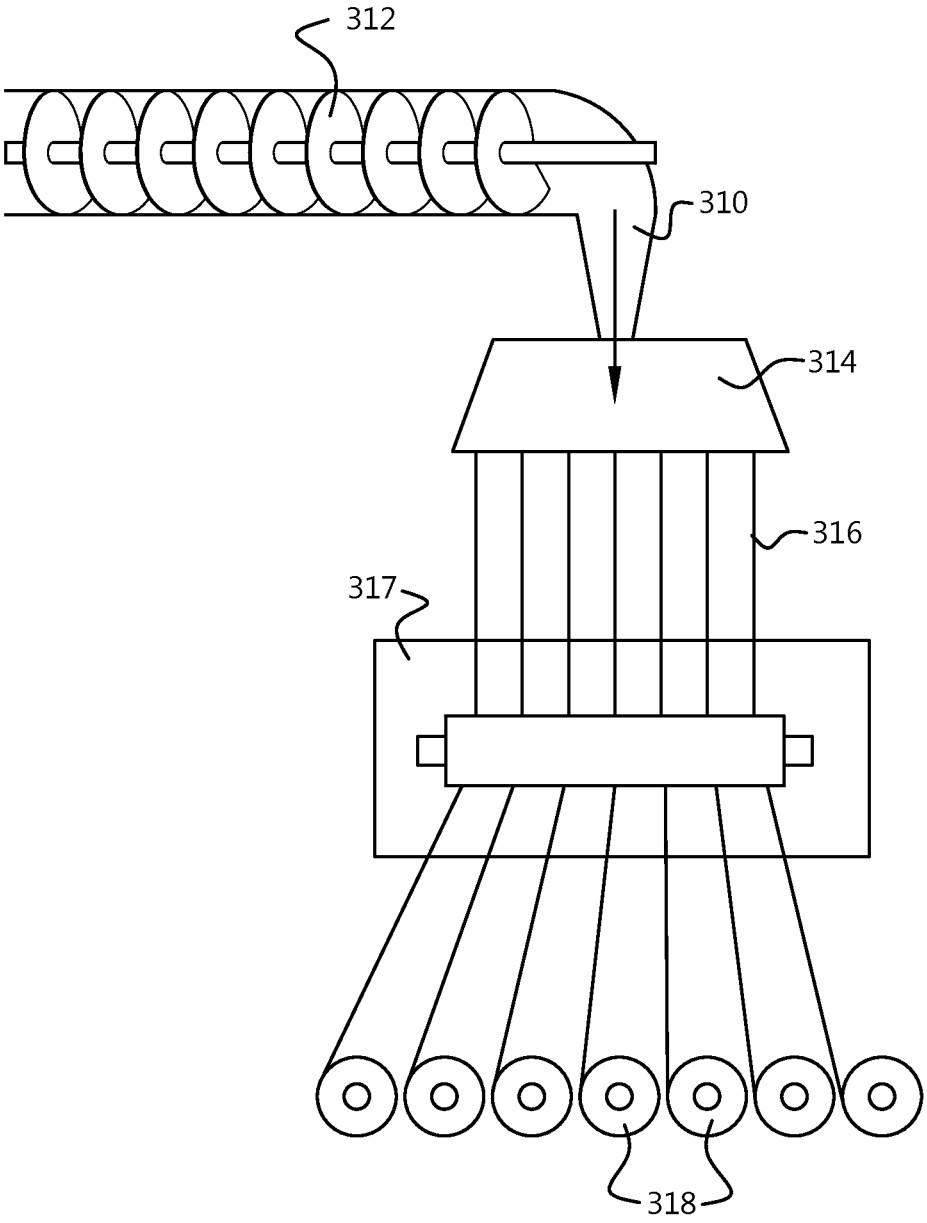
FIG. 12 shows an alternative procedure for forming filaments of foamable polymeric material

FIG. 12 shows an alternative procedure for forming filaments of foamable polymeric material. According to this embodiment, an extruder 312 delivers foamable PE extrudate 310 to a die-head 314, where it is extruded as filaments 316. The foamable PE includes suitable blowing and chemical cross-linking agents which are not activated at the extrusion temperature of 150° C. The filaments 316 are fed through a cooling bath 317 and subsequently wound onto spools 318. The un-foamed and un-crosslinked filaments may subsequently be integrated into woven precursor textiles as described above. After weaving, the filaments 316 can be cross-linked and foamed in a single step by exposure to heat at around 180° C. An advantage of the extruded filaments 316 is that they may be formed in a wide variety of cross-sectional shapes and weights according to the shape and size of the extruder die-head 314.

Thus, the invention has been described by reference to certain aspects discussed above. It will be recognized that these aspects are susceptible to various modifications and alternative forms well known to those of skill in the art. In particular, the invention is not limited to any particular weave structures and as it can be seen, depending on the nature of the weave structure, the filaments can be guided to expand in a given manner to achieve a different resulting effect.

Many modifications in addition to those described above can be made to the structures and techniques described herein without departing from the spirit and scope of the invention. Accordingly, although specific aspects have been described, these are examples only and are not limiting upon the scope of the invention.

The invention claimed is:

1. An unfoamed, woven precursor textile having a warp and a weft and comprising filaments of chemically cross-linked polymeric material, containing a chemical blowing agent, which, on subjecting to a foaming temperature of at least 150° C., expands by at least 5 times its volume to form a closed-cell foamed fabric.

2. The precursor textile according to claim 1, wherein the filaments are arranged in the warp.

3. The precursor textile according to claim 1, further comprising fibres of non-foamed material.

4. The precursor textile according to claim 3, wherein the filaments are present as at least 20% of the fabric by weight.

5. A foamed fabric formed by foaming of the precursor textile according to claim 1, having a net density of between 30 $Kg/m^3$ and 100 $Kg/m^3$.

6. The foamed fabric according to claim 5, having a first impact shock absorption value of greater than 25% force reduction (Fmax).

7. A foamed fabric formed by foaming the precursor textile according to claim 1, wherein the filaments extend out of a plane of the fabric in the form of open arches.

8. A foamed fabric formed by foaming the precursor textile according to claim 7, wherein during foaming the filaments expand and extend to form the open arches.

9. A foamed fabric formed by foaming the precursor textile according to claim 1, having a thickness of at least 5 mm and a weight of less than 1000 $g/m^2$.

10. A garment, a garment portion, a mat, an underlay, a furnishing element or a seating element, comprising a precursor textile according to claim 1.

11. The precursor textile according to claim 1, further comprising other fibres of non-foamed materials, wherein the size of the cross sectional area of the filaments in an unfoamed state with respect to the other fibres is between 0.1x and 100x.

12. A foamed fabric formed by foaming the precursor textile according to claim 1, wherein the precursor textile expands at the foaming temperature by at least 5 times its volume.

13. A foamed fabric formed by foaming the precursor textile according to claim 1, wherein the precursor textile expands at the foaming temperature by at least 10 times its volume.

14. A foamed fabric formed by foaming the precursor textile according to claim 1, wherein the precursor textile expands at the foaming temperature by at least 20 times its volume.

15. The precursor textile according to claim 1, wherein the polymeric material is polyethylene, ethylene vinyl acetate or a blend thereof.

16. The precursor textile according to claim 1, wherein the cross-linked polymeric material ensures the precursor textile is stable to at least 180° C.

17. A foamed fabric comprising a woven textile having a warp and a weft and filaments of chemically cross-linked polymeric material, which have been foamed to form closed-cell foamed filaments that extend out of a plane of the fabric in the form of open arches.

18. The foamed fabric according to claim 17, wherein foaming takes place subsequent to forming the precursor textile into a further product.

19. An unfoamed, woven precursor textile having a warp and a weft and comprising filaments of chemically cross-linked polymeric material, containing a chemical blowing agent, which, on subjecting to a foaming temperature of at least 150° C., forms a closed-cell foamed fabric, wherein the weight of the filaments is between 10,000 dtex and 50,000 dtex.

* * * * *